US007175681B2

(12) United States Patent
Hatanaka

(10) Patent No.: US 7,175,681 B2
(45) Date of Patent: Feb. 13, 2007

(54) APPARATUS FOR REMOVING FINE PARTICLES IN EXHAUST GAS

(75) Inventor: Yoshihiro Hatanaka, Kawasaki (JP)

(73) Assignee: National University Corporation, Tokyo University of Marine Science and Technology, Tokyo (JP)

( * ) Notice: Subject to any disclaimer, the term of this patent is extended or adjusted under 35 U.S.C. 154(b) by 0 days.

(21) Appl. No.: 11/165,022

(22) Filed: Jun. 24, 2005

(65) Prior Publication Data

US 2005/0262817 A1 Dec. 1, 2005

Related U.S. Application Data

(63) Continuation of application No. PCT/JP03/16847, filed on Dec. 26, 2003.

(30) Foreign Application Priority Data

Dec. 26, 2002 (JP) ..... 2002-377840

(51) Int. Cl.
*B01D 46/00* (2006.01)

(52) U.S. Cl. ..... 55/282.3; 55/282.2; 55/385.3; 55/486; 55/495; 55/497; 55/498; 55/512; 55/518; 55/523; 55/527; 55/DIG. 10; 55/DIG. 30; 60/311

(58) Field of Classification Search ..... 55/282.2, 55/282.3, 385.3, 486, 487, 490.1, 495, 497, 55/498, 512, 516, 518, 523, 527, 528, DIG. 10, 55/DIG. 30; 60/311
See application file for complete search history.

(56) References Cited

U.S. PATENT DOCUMENTS 4,940,213 A * 7/1990 Ohmine et al. ..... 55/314
4,979,364 A * 12/1990 Fleck ..... 60/311
5,180,559 A * 1/1993 Ma ..... 55/DIG. 30
5,211,845 A * 5/1993 Kaneshige ..... 210/186
5,655,366 A * 8/1997 Kawamura ..... 55/523
2003/0177907 A1* 9/2003 Aubert ..... 55/490.1

FOREIGN PATENT DOCUMENTS

| | | | |
|---|---|---|---|
| DE | 103 45 925 A1 | * | 5/2005 |
| JP | 61-171514 | * | 8/1986 |
| JP | 6-108820 | * | 4/1994 |
| JP | 7-180530 | | 7/1995 |
| JP | 7-224632 | * | 8/1995 |
| JP | 8-326522 | * | 12/1996 |
| JP | 2001-164924 | | 6/2001 |
| JP | 2001-349211 | | 12/2001 |
| JP | 2002-47914 | | 2/2002 |
| JP | 2002-58961 | * | 2/2002 |

OTHER PUBLICATIONS

"Eco Industry" (CMC Publishing Co., Ltd., Feb. 2001, p. 12-18).

* cited by examiner

*Primary Examiner*—Jason M. Greene
(74) *Attorney, Agent, or Firm*—Oblon, Spivak, McClelland, Maier & Neustadt, P.C.

(57) ABSTRACT

The present invention provides a fine particle removing apparatus which can efficiently burn collected fine particles in exhaust gas, has a simple configuration and can be readily controlled. In this fine particle removing apparatus, a filter unit which collects fine particles in the exhaust gas is arranged in a housing formed of a non-magnetic material through which the exhaust gas passes. By supplying a high-frequency current to a working coil wound around an outer peripheral section of the housing, support plates arranged in this filter unit are subjected to induction heating, and fine particles accumulated in the filter unit are burned with heat generated by this induction heating.

6 Claims, 4 Drawing Sheets

APPARATUS FOR REMOVING FINE PARTICLES IN EXHAUST GAS

CROSS-REFERENCE TO RELATED APPLICATIONS

This is a Continuation Application of PCT Application No. PCT/JP03/16847, filed Dec. 26, 2003, which was published under PCT Article 21(2) in Japanese.

This application is based upon and claims the benefit of priority from prior Japanese Patent Application No. 2002-377840, filed Dec. 26, 2002, the entire contents of which are incorporated herein by reference.

BACKGROUND OF THE INVENTION

1. Field of the Invention

The present invention relates to a fine particle removing apparatus which removes fine particles, especially flammable fine particles in exhaust gas from a diesel engine, a boiler, an incinerator or the like, and to a filter unit used in this fine particle removing apparatus.

2. Description of the Related Art

Various types of diesel particulate filters (DPFs) which collect harmful fine particles emitted from a diesel engine have been developed.

For example, Jpn. Pat. Appln. KOKAI Publication No. 8-826522 discloses a DPF comprising: a pipe formed of a non-magnetic material; a metallic filter which is arranged in this pipe formed of a non-magnetic material and in which many elongated exhaust gas paths are formed by regularly arranging many metallic members such as metal sheets or small-diameter metallic pipes; and a coil which is arranged on the outer periphery of this pipe formed of a non-magnetic material and to which a high-frequency current is supplied.

In this apparatus, an eddy current is induced in the surfaces of many metallic members which partition the elongated exhaust gas paths of the metallic filter by supplying a high-frequency current to the coil, and the metallic members are heated to a high temperature which is approximately 600° C. or above by Joule heat produced from this eddy current. When exhaust gas flows through these elongated exhaust gas paths, flammable fine particles in the exhaust gas come into contact with the high-temperature metallic members which partition the elongated exhaust gas paths, and hence the fine particles are burned.

However, this DPF constantly supplies a high-frequency current to the coil during the operation, and a large quantity of current is thereby consumed. Further, when the exhaust gas paths are elongated in order to efficiently burn flammable fine particles in the exhaust gas, the size of the entire apparatus is increased, the energy required for heating is increased, and hence combustion cannot be efficiently performed.

Furthermore, "ECO INDUSTRY" (CMC Publishing Co., Ltd., February 2001, p. 12–18) discloses a DPF manufactured by holding a sheet of ceramic fiber felt by a wire mesh heater from both sides to be formed into a plate-like shape, combining many the plate-like felt sheets and heaters to form a pleated filter element and accommodating this filter element in a casing. Two DPFs are arranged in parallel, exhaust flow paths are switched by using a control valve provided on the upstream side so that fine particles are collected on one hand and regeneration is carried out on the other hand, thereby always collecting fine particles. Regeneration of this DPF is performed by energizing the wire mesh heaters in each filter element and burning fine particles collected in the felt.

The DPF having the pleated filter elements is very beneficial in that the breakage of the filter elements due to the heat stress in regeneration is avoided and collection and regeneration of fine particles are possible irrespective of fuel properties, but the wire mesh heater formed of a thin metal is arranged on the surface of the ceramic fiber felt, and hence this wire mesh heater is always exposed to the exhaust gas and heated to a very high temperature at the time of regeneration. Therefore, the wire forming the wire mesh heater may be possibly disconnected. Furthermore, since the two DPFs are alternately used for collection and regeneration, the configuration and the combustion control become very complicated.

Thus, development of a DPF which has a compact configuration but can efficiently remove flammable fine particles in exhaust gas has been desired.

BRIEF SUMMARY OF THE INVENTION

In view of the above-described problems, it is an object of the present invention to provide a fine particle removing apparatus which can efficiently burn collected flammable fine particles in exhaust gas in a short period of time, has a simple configuration and is easy to be controlled.

To achieve the object, according to the present invention, there is provided an apparatus which removes fine particles in exhaust gas, wherein a collection device which collects fine particles in exhaust gas is arranged in a housing through which the exhaust gas passes and is formed of a non-magnetic material, and a heating member arranged in this collection device is subjected to induction heating by supplying a high-frequency current to a coil wound around an outer peripheral section of the housing so that fine particles collected in the collection device are burned by heat generated from induction heating.

Moreover, according to the present invention, there is provided a filter unit which is arranged in a housing which has a coil wound around an outer peripheral section thereof, permits the passage of exhaust gas, is formed of a non-magnetic material, and collects fine particles in the exhaust gas, the filter unit having a porous support plate which allows the exhaust gas which has flowed in from one side to flow out to the other side and supports collected fine particles, the support plate burning the collected fine particles by a heating member which is subjected to induction heating when a high-frequency current is supplied to the coil.

DETAILED DESCRIPTION OF THE INVENTION

Figure 1:
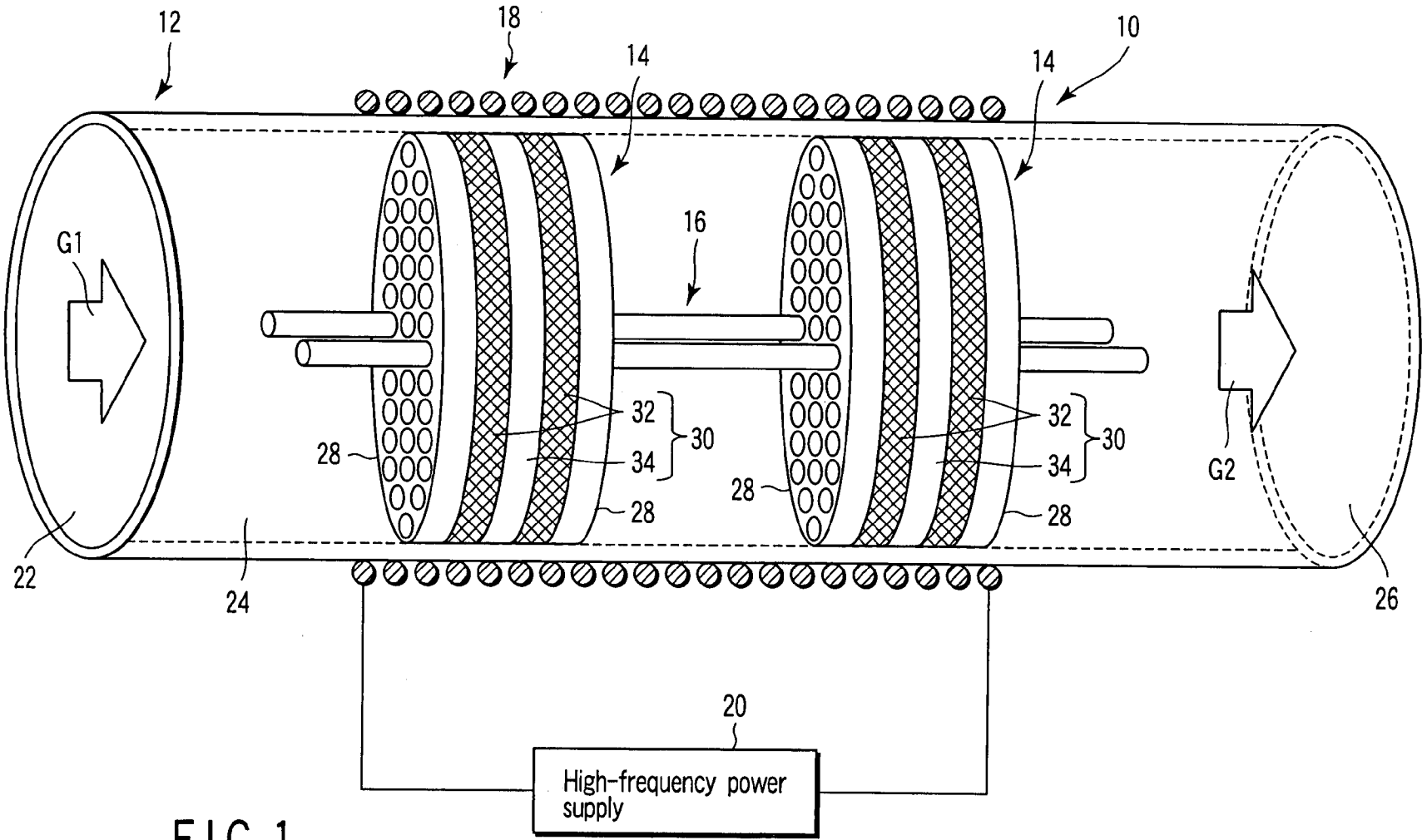
FIG. 1 is an explanatory view of a fine particle removing apparatus according to preferable embodiment of the present invention.

FIG. 1 shows a fine particle removing apparatus 10 according to a preferred embodiment of the present invention.

In this fine particle removing apparatus 10, two filter units 14 as collection devices which collect fine particles in exhaust gas are arranged in a non-magnetic material cylindrical housing 12 formed of a ceramic material such as silicon nitride at intervals in an axial direction and these filter units 14 are coupled with each other by two support shafts 16 in this embodiment. Additionally, a working coil 18 formed by winding, e.g., a litz wire or a small-diameter metal tube having a hollow configuration is arranged on the outer side of the housing 12, and a high-frequency current which falls in a range of, e.g., 1 to 100 KHz, or preferably approximately 15 to 40 KHz is supplied to this working coil 18 from a high-frequency power supply 20 comprising a high-frequency inverter, thereby subjecting a later-described heating member of the filter unit 14 to induction heating. Audible sounds are generated when a frequency of the high-frequency current is much lower than 15 KHz and, on the contrary, a line of magnetic force is hard to reach a deep part, i.e., the vicinity of the central part of the housing 12 by the skin effect when the frequency is much higher than 100 KHz.

In this fine particle removing apparatus 10, the exhaust gas emitted from, e.g., a diesel engine, a boiler, an incinerator or the like flows into an inner flow path 24 of the housing along a direction of an arrow G1 from an inlet 22 at one end of this housing 12. Fine particles in the exhaust gas are collected by the two filter units 14, and the exhaust gas from which the fine particles are removed is emitted from an outlet 26 in a direction of an arrow G2.

It is to be noted that the number of the filter units 14 is not restricted to two as shown in the drawing, and one filter unit only or three or more filter units may be provided. In any case, the filter units 14 are arranged in a range of winding of the working coil 18, i.e., a magnetic flux reaching range. In case of arranging the plurality of filter units 14, the plurality of working coils 18 may be arranged in accordance with the respective filter units 14. Further, the support shafts 16 which couple the plurality of filter units 14 with each other can be arranged at appropriate positions as long as positions and gaps of the respective filter units 14 can be kept, the arrangement position of the support shafts 16 is not restricted to the central part as shown in the drawing, and the support shafts 16 may be arranged apart from each other at a position close to a peripheral section.

The filter unit 14 according to this embodiment comprises a pair of disk-shaped porous support plates 28 each of which is formed by forming many holes to a metal sheet such as SUS 430 as a heating member subjected to induction heating by the working coil 18, and has a sandwich configuration in which a ceramic fiber filter 30 which can withstand a fine particle burning temperature of, e.g., approximately 600° C. or above is arranged between the support plates 28. This ceramic fiber filter 30 has a laminated structure in which a blanket-like fiber layer 34 is sandwiched between TYRANNO-chop-like (short composite) fiber layers 32. It is preferable for the TYRANNO-chop-like (short composite) fiber forming this TYRANNO-chop-like (short composite) fiber layer 32 to be a ceramic continuous fiber consisting of silicon, titanium or zirconium, carbon and oxygen, and it is possible to use commercially available fibers having various filament diameters. Further, as the blanket forming the blanket-like fiber layer 34, it is preferable to use one obtained by subjecting ceramic fibers to needle processing while being laminated, fibers having commercially available alumina or silicon dioxide as main components can be used.

Such a ceramic fiber filter 30 is not restricted to the three-layer structure in which the blanket-like fiber layer 34 is sandwiched between the TYRANNO-chop-like (short composite) fiber layers 32, it may be formed by using one of ceramic fibers, and four more layers of ceramic fibers may be laminated. In case of using an odd-numbered layer configuration having three layers or five layers like the illustrated embodiment, the exhaust gas may be allowed to flow in from the porous support plate 28 on one side of the filter unit 14 and front and back directions do not have to be specified, thereby facilitating the assembling. Furthermore, when the ceramic fiber filter 30 has a large thickness, the same metallic member (not shown) as the support plate 28 may be arranged in a middle section thereof. On the other hand, when induction heating to a necessary temperature is possible with one porous support plate 28 only, any one support plate 28 can be formed as a metallic member for induction heating.

The exhaust gas which has flowed in from the inlet 22 of such a fine particle removing apparatus 10 passes through the filter units 14 while flowing through the inner flow path 24 to be discharged from the outlet 26. The exhaust gas is discharged from one porous support plate 28 from holes of the other porous support plate 24 of this filter unit 14 through the ceramic fiber filters 30, and soot-like or invisible fine particles are trapped by this ceramic fiber filters 30.

When a large quantity of fine particles are trapped in the filter units 14 and a difference in pressure between the inlet 22 and the outlet 26 reaches a preset value or above, a high-frequency current is passed to the working coil 18 from the high-frequency power supply 20. It is preferable to set this difference in pressure to a such a value that the efficiency of the normal operation of a diesel engine, a boiler, a incinerator or the like is not deteriorated.

When the working coil 18 is energized, an eddy current flows through the porous support plates 28 of the filter units 14, and the porous support plates 28 are heated to a high temperature (approximately 600° C.) in a short period in time by Joule heat generated due to a resistance component. The emitted fine particles (flammable particles occupy a large part thereof) trapped in the filter units 14 are burned in a short period in time, and the filter units 14 are thereby regenerated. This is carried out in order to efficiently burn the emitted fine particles at a high temperature with a small amount of oxygen in the exhaust gas. When a metal plate is arranged between the support plates 28, this metal plate is also subjected to induction heating together with the support plates 28, thereby burning the emitted fine particles in a shorter period in time.

Since this fine particle removing apparatus 10 does not need wire-like heaters and wirings connecting these heaters like those in the prior art, there is no possibility of disconnection. Further, since the metallic support plate 28 itself which supports the ceramic fiber filter 30 is formed as a heating member which generates heat, no disconnection occurs even when a large eddy current flows, and high-temperature heating can be efficiently performed from the both sides in a short period in time even though the configuration is very simple. Furthermore, regeneration can be carried out while operating a diesel engine or the like, and its control is very easy. In case of performing heating/regeneration while operating a diesel engine, a time and power required for combustion of emitted fine particles are small since heating is carried out with the filter units 14 being maintained at a high temperature, thereby increasing the efficiency. In particular, since fine particles with the high density trapped in the ceramic fiber filters 30 are burned in a short time, combustion can be efficiently performed with a small amount of electric energy.

It is to be noted that energization of the working coil 18 is not restricted to a difference in pressure between the inlet 22 and the outlet 26, and it can be carried out at each predetermined time.

Figure 2:
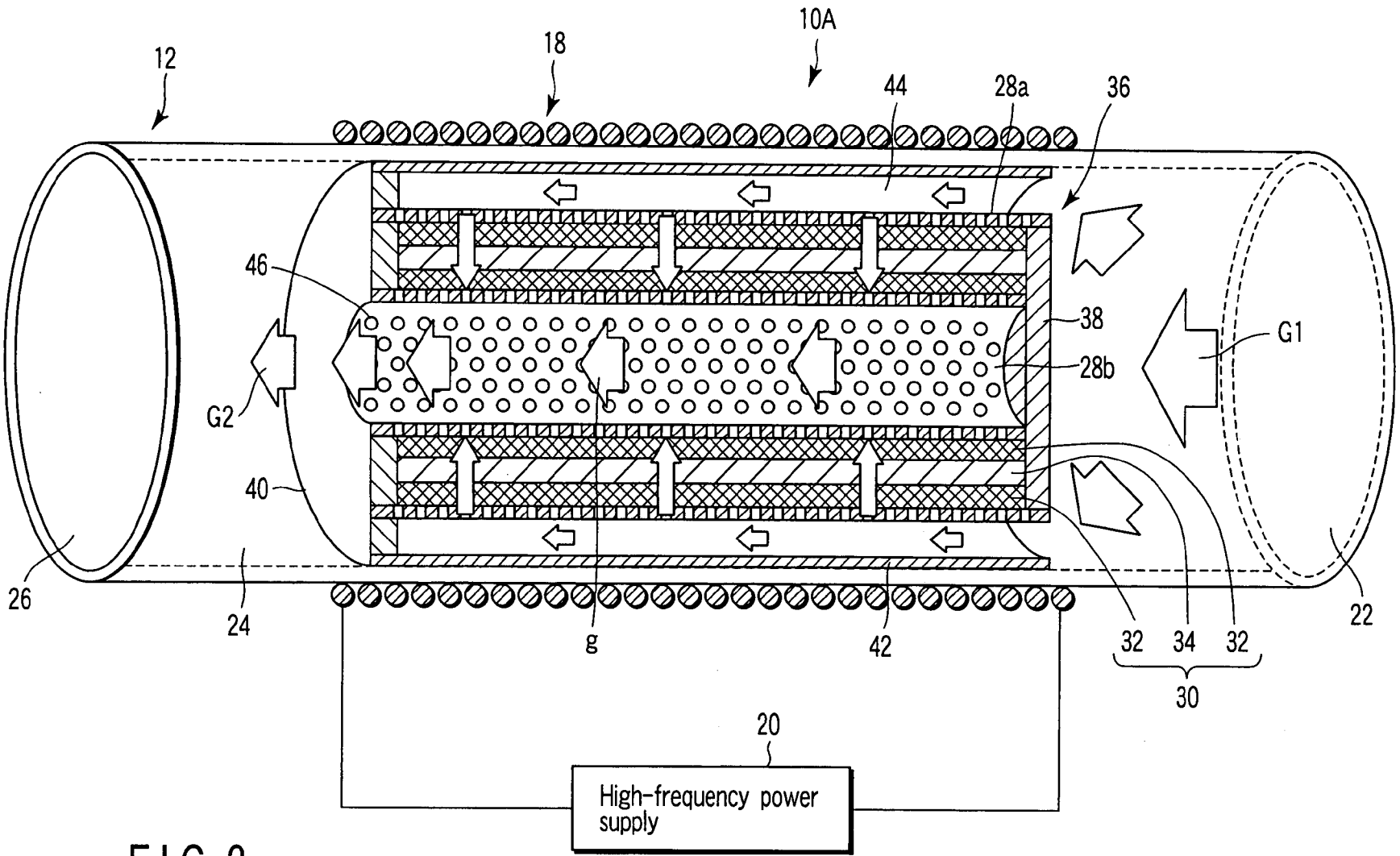
FIG. 2 is an explanatory view of a fine particle removing apparatus according to another embodiment.

FIG. 2 shows a fine particle removing apparatus 10A according to a second embodiment. Since the principle of reducing combustion of soot-like fine particles by induction heating of this embodiment is the same as that of the foregoing embodiment, like reference numerals denote like parts, thereby eliminating the detailed description thereof.

A filter unit 36 in the fine particle removing apparatus 10A according to the present embodiment has a cylindrical structure in which a ceramic fiber filter 30 is arranged between a cylindrical outer support plate 28*a* and a cylindrical inner support plate 28*b* each having many punch holes formed thereto, and is coaxially arranged in a housing 12. These porous support plates 28*a* and 28*b* are respectively coaxially held by stopper members 38 and 40 at end sections on an inlet 22 side and an outlet 26 side of the housing 12.

The stopper member 38 on the inlet 22 side seals an end section of an annular space formed between the support plates 28*a* and 28*b*, i.e., an accommodation space for the ceramic fiber filter 30, and also closes an end section of the inner support plate 28*b* so that an inner space of the inner support plate 28*b*, i.e., an axial hole is prevented from communicating with the inlet 22 of the housing 12. This stopper member 38 has an outer rim section fixed to the outer support plate 28*a*, and hence it does not protrude outwardly in a radial direction. Moreover, the stopper member 40 on the outlet 26 side seals an end section of an annular space formed between the support plates 28*a* and 28*b*. This stopper member 40 on the outlet 26 side has an opening which allows an axial hole provided on the inner side of the inner support plate 28*b* to communicate with the outside, i.e., an inner path 24 of the housing 12, and extends outwardly in a radial direction beyond the outer support plate 28*a*. It is preferable to form these stopper members 38 and 40 by using a preferable plate material such as SUS 316

A cylindrical annular member 42 formed of a preferable non-magnetic material such as SUS 316 is arranged as an auxiliary heating member at an outer rim section of this stopper member 40. This annular member 42 is appressed against an inner peripheral surface of the housing 12, and forms an exhaust gas flow path 44 between itself and the outer support plate 28*a*.

In this fine particle removing apparatus 10A, exhaust gas G1 which has flowed in from the inlet 22 of the housing 12 enters the ceramic fiber filter 30 from the annular exhaust gas flow path 44 formed between the annular member 42 of the filter unit 36 and the outer support plate 28*a* through many punch holes of the outer support plate 28*a*. After removing the fine particles by this ceramic fiber filter 30, the exhaust gas passes through the exhaust gas flow path 46 formed of axial holes of the support plate 38*b* from many punch holes formed to the inner support plate 28*b*, and is discharged from the outlet 26. Reference character g denotes a flow of the gas in the exhaust gas flow path 46.

In this embodiment, as compared with the embodiment depicted in FIG. 1, since a very large flow area for the exhaust gas can be formed and the exhaust gas flow path can be formed into a labyrinthine shape, the fine particle collection efficiency can be increased.

In this fine particle removing apparatus 10A, when regenerating the filter unit 36, the annular member placed on the outer side of the outer support plate 28*a* is heated to a high temperature in a short period in time by utilizing the skin effect, and serves as an auxiliary heating member which aids heating the ceramic fiber filter 30 sandwiched between the inner support plates 28*a* and 28*b* in a short time.

The filter unit 36 can be formed into a truncated cone shape instead of a cylindrical shape. In this case, the small-diameter side may be oriented to either the inlet 2 side or the outlet 26 side. In case of forming the annular member 42 into a truncated cone shape by which the diameter is reduced toward the inlet 22 side, forming many punch holes is preferable. Alternatively, the annular member 42 can be eliminated.

Figure 3:
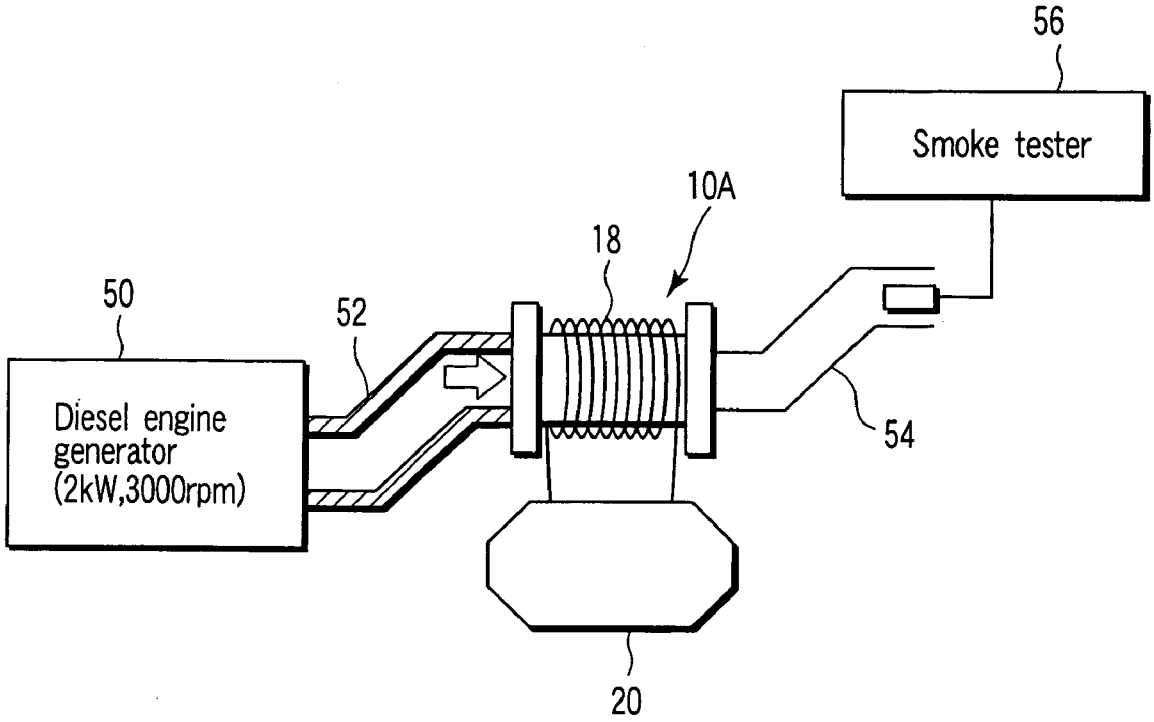
FIG. 3 is an explanatory view showing a state in which the fine particle removing apparatus depicted in FIG. 2 is attached to a diesel generator.

FIG. 3 is a schematic view of an experimental apparatus with which the fine particle removing effect by the fine particle removing apparatus depicted in FIG. 2 was confirmed.

In the experiment, the exhaust gas was led from a diesel engine generator 50 to the inlet 22 side of the fine particle removing apparatus 10A by using a heat-resistant hose 52, and the outlet 26 side was opened to the atmosphere through an exhaust pipe 54.

Table 1 shows a specification of the diesel engine generator 50 used in this experiment, and Table 2 shows a specification of a smoke tester 56. In a diesel engine, heavy oil A with the lower quantity was used in place of light oil as a specified fuel, and black smoke containing a large quantity of soot-like fine particles was generated.

TABLE 1

Specification of Generator Manufacturer: Yanmar Diesel Engine Co., Ltd.

| Model name (type name) | | | Unit | YDG250A-5E |
|---|---|---|---|---|
| Generator | Type | | | Self-exciting rotary field alternating generator, capacitor compensation type brushless |
| | Frequency | | Hz | 50 |
| | Rated output | | kVA | 2.0 |
| | Rated voltage | | V | 100 |
| | Rated current | | A | 20 |
| | Number of phases | | | Single phase |
| | Number of poles | | | 2 |
| | Power factor | | | 1.0 |
| Engine | Name | | | L48ADGY5/6 |
| | Type | | | Vertical air-cooled four-cycle diesel engine |
| | Combustion mode | | | Direct injection type |
| | Cylinder diameter × strokes | | mm | ϕ70 × 55 |
| | Total cylinder capacity | | l | 0.211 |
| | Output | Continuous rating | kW/rpm | 2.8/3000 |
| | | Maximum | kW/rpm | 3.1/3000 |

TABLE 2

| Diesel Smoke Meter (Nissan Altia Co., Ltd.) | |
|---|---|
| Item number | ED1949 |
| Standard | ST-100N |
| Transportation ministry type approval number | DS-7 |
| Measurement principle | Filter paper reflection type |
| Measurement range | 0 to 100% (pollution level) |
| Measurement accuracy | ±3% of full scale |
| Response speed | Within 2 seconds |
| Power supply | AC100V 50/60 Hz |
| Main body outside dimension | 400 (H) × 445 (width) × 330 (depth) [mm] |
| Weight | Approximately 13 kg |

Further, in the fine particle removing apparatus 10A, outside diameters of the housing 12 and the cylindrical member 42 were respectively determined as approximately 100 mm and 98 mm, the outer and inner support plates 28*a* and 28*b* were formed to respectively have outside diameters of approximately 70 mm and 50 mm, and the working coil 18 was formed of a hollow copper thin tube having a diameter of approximately 4 mm and wound along an axial length of approximately 300 mm.

The concentration of the emitted fine particles including soot and the like in the exhaust gas was measured at an outlet section of the exhaust tube 54 by using a smoke tester 56. In this experiment, there were carried out confirmation of the fine particle removing effect by the fine particle removing apparatus 10A and conformation of the regeneration effect of the fine particle removing apparatus 10A by induction heating.

FIG. 4 show the fine particle removing effect by the fine particle removing apparatus 10A.

Figure 4A:
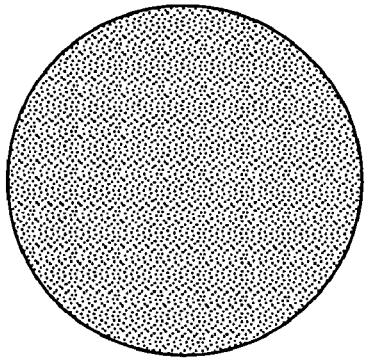
FIGS. 4A and 4B are explanatory views showing measurement states of a smoke tester in a state in which the fine particle removing apparatus is not set and a state in which the fine particle removing apparatus is set.
Figure 4B:
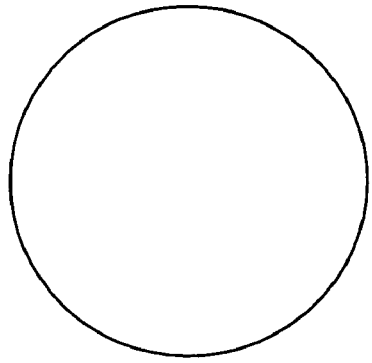

FIG. 4A schematically shows the black smoke concentration (84%) measured by the smoke tester for the exhaust gas without using a filter, and FIG. 4B schematically shows the concentration (0.12%) when the black smoke is passed through the fine particle removing apparatus 10A.

Table 3 shows a measurement result obtained by the smoke tester 56 when the fine particle removing apparatus 10A is not set. Based on the measurement result shown in Table 3, assuming that the black smoke concentration when the fine particle removing apparatus 10A is not set is determined as a reference (100%), a soot-like fine particle reduction ratio when the black smoke is passed through the fine particle removing apparatus 10A realizes the high efficiency which is approximately 100%. Here, the soot-like fine particle reduction ratio is defined by the following Relational Expression (1). That is, Relational Expression (1) is represented as the soot-like fine particle reduction ratio (%)={1−(the black smoke concentration when the fine particle removing apparatus 10A is set)/(the black smoke concentration when the fine particle removing apparatus 10A is not set)}×100.

TABLE 3

| Black Smoke Concentration when Filter is not Used | 1st time | 2nd time | 3rd time | Average |
|---|---|---|---|---|
| Smoke tester black smoke concentration | 84% | 84% | 83% | 83.67% |

Further, Table 4 shows the regeneration effect of the fine particle removing apparatus 10A by induction heating.

In this experiment, after the fine particle removing apparatus 10A was regenerated by induction heating, the diesel engine was started for five times, and soot-like fine particles were collected in each starting operation. Then, the collected soot-like fine particles were burned by induction heating, this fine particle removing apparatus 10A was regenerated, and then the soot-like fine particles were again collected in the diesel engine starting operations. It is to be noted that the soot-like fine particle reduction ration was calculated based on Relational Expression (1) mentioned above.

TABLE 4

| Black Smoke Concentration when Cylindrical filter is Set | | Number of times of diesel engine starting operation | | | | | | Soot-like fine particle reduction ratio |
|---|---|---|---|---|---|---|---|---|
| | | 1st time | 2nd time | 3rd time | 4th time | 5th time | Av. value | |
| Smoke tester black smoke conc. | Before induction heating | 1% | 0% | 0% | 0% | 0% | 0.2% | 99.8% |
| | After 1st induction heating treatment | 0% | 0% | 0% | 0% | 0% | 0% | 100% |
| | After 2nd induction heating treatment | 2% | 0% | 0% | 0% | 0% | 0.4% | 99.5% |
| | After 3rd induction heating treatment | 0% | 0% | 0% | 0% | 0% | 0% | 100% |
| | After 4th induction heating treatment | 0% | 0% | 0% | 0% | 0% | 0% | 100% |

As apparent from the above description, as different from a conventional automobile DPF, the fine particle removing apparatus 10 or 10A comprising the filter unit 14 or 36 which is regenerated by utilizing induction heating does not have a wiring section like a wire-shaped heater at a part coming into contact with the exhaust gas, and the support plate 28 which supports the ceramic fiber filter in the sandwiching manner serves as a heating source which generates heat at a high temperature in a short time by energizing the non-contact induction heating working coil with a high-frequency alternating current. Therefore, the fine particle removing apparatus 10 or 10A can use a compact structure to efficiently heat the ceramic fiber filter in a short time without the concern about disconnection of the heating member. As a result, the emitted fine particles can be burned in a short time, and regeneration of the filter can be easily repeated, which is very beneficial for the maintenance.

In the fine particle removing apparatus according to each of the foregoing embodiments, although the ceramic fiber filter 30 which can withstand a high temperature which is not lower than the above-described combustion temperature (approximately 600° C.) is used, it is obvious that the present invention is not restricted thereto and any other collection member or collection device can be used as long as the support plate 28, 28*a* or 28*b* which is subjected to induction heating can collect fine particles in a direct heating enabled state. For example, by forming a hole diameter of the support plate 28, 28*a* or 28*b* to, e.g., approximately 10 μm, fine particles can be directly collected by this support plate 28, 28*a* or 28*b* and the collected fine particles can be supported or held until heating and regeneration. In this case, the collection device or the filter unit 14 or 36 can be formed by using one support plate only.

Further, the filter itself as the collection member may be allowed to generate heat.

Figure 5B:
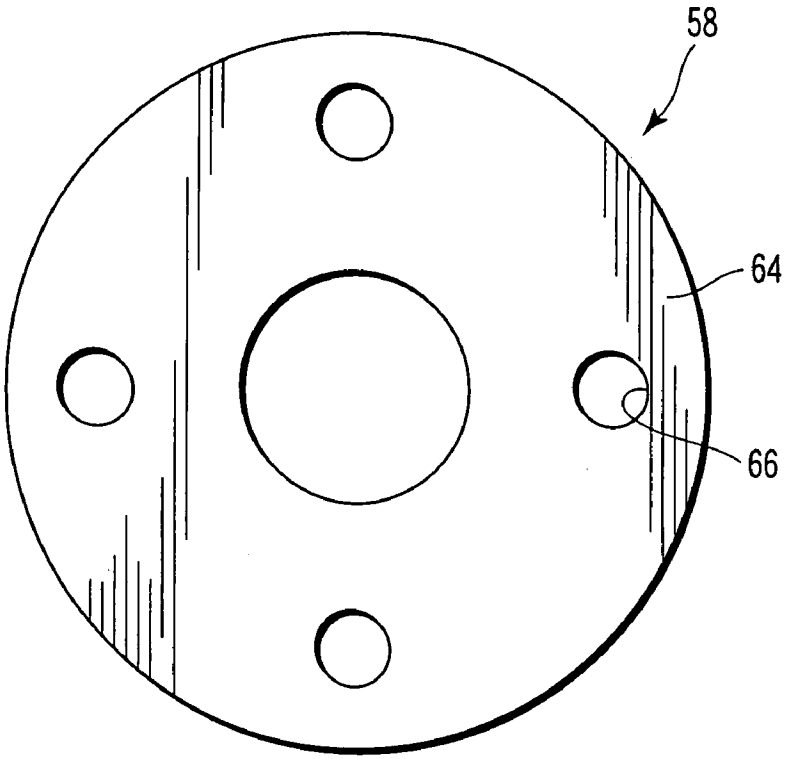
FIG. 5B is a view taken along a line B—B in FIG. 5A.
Figure 5A:
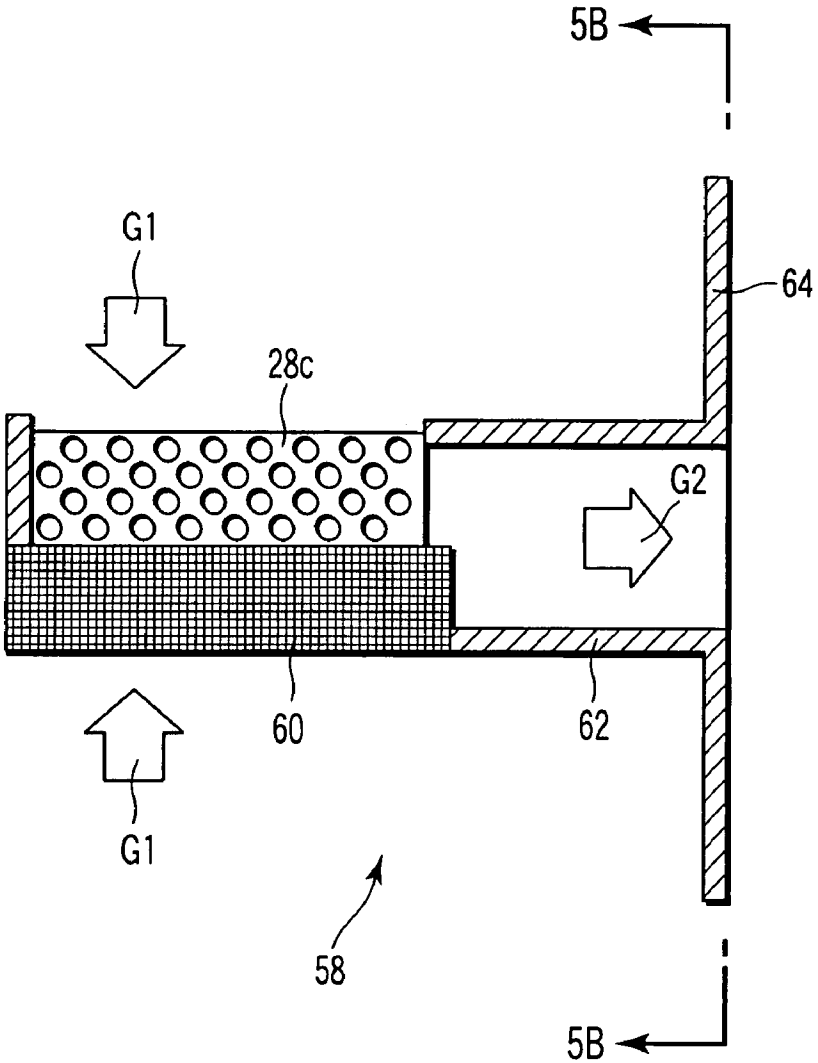
FIG. 5A is a partial cross-sectional view of a filter unit according to still another embodiment.

FIGS. 5A and 5B show a filter unit 58 which can allow the filter itself to generate heat with the housing 12 and the working coil 18 being eliminated. This filter unit 58 has a cylindrical configuration in which a sintered nonwoven fabric filter 60 formed by sintering metallic fibers is attached along an outer periphery of a cylindrical support plate 28*c* having many punch holes formed thereto. This filter unit 58 further has a cylindrical extended section 62 extending from one end side of the support plate 28*c* and a flange 74 extending from an end of this extended section in a radial direction, and the other end side of the support plate 28*c* is closed. The support plate 28*c*, the extended section 62 and the flange 74 are formed of a non-magnetic metal such as stainless steel.

This filter unit 58 can be attached to the housing 12 through attachment holes 66 formed to the flange 64. A pressure of the exhaust gas G1 acting on the sintered nonwoven fabric filter 60 is supported by the support plate 28*c*, and this sintered nonwoven fabric filter 60 is protected against the pressure of the exhaust gas.

In this embodiment, this sintered nonwoven fabric filter 60 is formed of the metallic fiber which is available under the brand name "BECRARY" from Bekaert Asia, Tokyo branch. This metallic fiber is a magnetic body containing 19.50% of Cr, 4.55% of Al, 0.25% of Y and a remaining percentage of Fe as main components and having a maximum working temperature of 1000° C. The sintered nonwoven fabric filter 60 having such a sintered metallic fiber usually has a high void ratio of 60 to 85%, and hence a high transmission flow quantity can be obtained even though pressure losses are small. Comparing a sinter of this metallic fiber is compared with a sinter of stainless powder, a transmission flow quantity of water which is approximately 14-fold can be obtained when a filter particle size is 4 μm.

The sintered nonwoven fabric filter 60 having such a metallic fiber can three-dimensionally fetch foreign particles from the exhaust gas, and has the excellent capability of collecting foreign particles from the exhaust gas. Furthermore, it is superior to ceramic in heat resisting properties and the mechanical strength, and also has anti-corrosion properties against sulfides. Therefore, it is preferable as a filter for a marine DPF which receives large vibrations.

In this filter unit 58, since the sintered nonwoven fabric filter 60 is formed of the metallic fiber, the support plate 28*c* as well as the sintered nonwoven fabric filter 60 is subjected to induction heating when the working coil 18 is excited with a high-frequency current. Therefore, trapped fine particles can be very efficiently burned.

Table 5 shows a result obtained by conducting an experiment of the fine particle removing apparatus using this filter unit 58 by utilizing the experimental apparatus depicted in FIG. 3 like the foregoing embodiment.

TABLE 5

Result of Particle Collection Experiment (initial pressure: 0.06)

| | Number of times of engine starting operation | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Black smoke concentration (%) | 3.0 | 1.0 | 0 | 0 | 0 | 0 | 0 | 0 | 0 | 0 | 0 | 0 | 0 | 0 |
| Pressure loss (kPa) | 3.06 | 3.06 | 2.96 | 2.88 | 2.96 | 3.32 | 3.68 | 4.02 | 4.60 | 5.32 | 5.78 | 6.28 | 6.82 | 7.26 |

From this experimental result, a small mount of black smoke is generated when the number of times of starting operation is small, i.e., when the pressure loss is small, but the pressure loss is increased and no black smoke is generated when the number of times of starting operation is increased. It is considered that this phenomenon occurs because fine particles in the exhaust gas are collected and deposited by the sintered nonwoven fabric filter 60 and very small fine particles are also thereby collected by the sintered nonwoven fabric filter 60. Further, when the pressure loss reached 4 kPa, a high-frequency current was supplied to the working coil 18, and the filter unit 58 was heated for three minutes. As a result, the surface of the sintered nonwoven filter 60 which was black before heating restored the metallic luster.

As apparent from the above described, according to the fine particle removing apparatus of the present invention, although the configuration is very simple and the control is easy, fine particles in the exhaust gas can be efficiently burned in a short time. Therefore, the present invention can be very preferably applied to not only a diesel engine in a road motor truck, a construction vehicle or a marine vessel but also a boiler or a incinerator which emits fine particles including flammable particles.

What is claimed is:

1. An apparatus which removes fine particles in exhaust gas exhausted from at least one of a diesel engine, a boiler and an incinerator, comprising:

a housing formed of a non-magnetic material through which the exhaust gas passes;

a coil which is wound around an outer peripheral section of the housing;

a high-frequency power supply which is configured to supply a high-frequency current to the coil; and a collection device which is arranged in the housing and collects fine particles in the exhaust gas, wherein the collection device comprises a filter formed of sintered nonwoven fabric filter formed by sintering metallic fibers and configured to withstand a temperature of at least 600° C. and to trap the fine particles, and a support supporting the filter on the housing, and configured to allow the exhaust gas which has flowed in from one side to flow out from the other side, and wherein at least the filter generates heat with an eddy current induced therein when the high-frequency current is supplied to the coil to a temperature of at least 600° C. to burn the fine particles trapped by the filter.

2. The apparatus according to claim 1, wherein the collection device is formed as a filter unit, wherein the support comprise a porous support plate having a cylindrical configuration, one end of the porous support plate being closed, and the filter has a cylindrical outer configuration attached to an outer surface of the porous support plate.

3. A filter unit which has a coil wound around an outer peripheral section thereof, is arranged in a housing formed of a non-magnetic material through which exhaust gas exhausted from at least one of a diesel engine, a boiler and an incinerator passes, and collects fine particles in the exhaust gas, wherein the filter unit includes a filter formed of sintered nonwoven fabric filter formed by sintering metallic fibers and configured to withstand a temperature of at least 600° C. and to collect the fine particles, and a support supporting the filter on the housing, and configured to allow the exhaust gas which has flowed in from one side to flow out from the outer side, and wherein at least the filter generates heat with an eddy current induced therein when a high-frequency current is supplied to the coil to a temperature of at least 600° C. to bum the fine particles trapped by the filter.

4. A filter device configured to remove particles in exhaust gas flowing through the device, the filter device comprising:

a housing configured to receive the exhaust gas;

a coil disposed on an outside of the housing;

a current supply configured to supply a current to the coil; and a collection device disposed in the housing and configured to remove the particles from the exhaust gas, the collection device comprising a support plate attached to the housing, and a filter formed of sintered nonwoven fabric filter formed by sintering metallic fibers, configured to collect the particles from the exhaust gas and supported on the support plate, and induction heating to burn the collected particles when a current is supplied to the coil.

5. The apparatus according to claim 2, wherein both the filter and the porous support plate generate heat with the eddy current induced therein, when the high-frequency current is supplied from the high-frequency power supply to the coil.

6. The apparatus according to claim 2, wherein the collection device is attached to the housing via an extended section extending from another end of the porous support plate.

* * * * *